US010525372B2

(12) United States Patent
Fish

(10) Patent No.: US 10,525,372 B2
(45) Date of Patent: Jan. 7, 2020

(54) UNISTRUCTURAL POP-UP HALF BALL TOY

(71) Applicant: KMA Concepts Limited, North Point (HK)

(72) Inventor: Peter Alan Fish, Wyong Creek (AU)

(73) Assignee: KMA Concepts Limited, North Point (HK)

( * ) Notice: Subject to any disclaimer, the term of this patent is extended or adjusted under 35 U.S.C. 154(b) by 0 days.

(21) Appl. No.: 15/944,752

(22) Filed: Apr. 3, 2018

(65) Prior Publication Data

US 2018/0290071 A1 Oct. 11, 2018

(30) Foreign Application Priority Data

Apr. 6, 2017 (AU) ..... 2017100391

(51) Int. Cl.
*A63H 37/00* (2006.01)

(52) U.S. Cl.
CPC ..... *A63H 37/005* (2013.01)

(58) Field of Classification Search
CPC ..... A63H 37/005; A63H 11/06
USPC ..... 446/4, 46, 308, 309, 385, 485, 486
See application file for complete search history.

(56) References Cited

U.S. PATENT DOCUMENTS 564,686 A 7/1896 Gottschalk et al.
1,676,296 A 7/1928 Spencer
2,153,957 A 4/1939 Davis
2,627,700 A 2/1953 Weiss
2,952,460 A 9/1960 Ellis
3,218,071 A 11/1965 Richard
4,152,863 A 5/1979 Kubiatowicz
5,213,538 A 5/1993 Willett
5,334,079 A * 8/1994 Gentile ..... A63H 27/14 446/308
D355,231 S 2/1995 Chien
5,984,753 A 11/1999 Perez
D527,427 S 8/2006 Andersen
7,335,085 B2 2/2008 Lyman
7,803,033 B1 * 9/2010 Walterscheid ..... A63H 37/005 446/308
7,927,177 B1 4/2011 Walterscheid
8,464,665 B1 6/2013 Scheffler et al.
9,095,781 B2 8/2015 Tiefel et al.
9,526,998 B2 12/2016 Hudson et al.
2008/0233832 A1 9/2008 Lirot
(Continued)

*Primary Examiner* — Vishu K Mendiratta
(74) *Attorney, Agent, or Firm* — LaMorte & Associates, P.C.

(57) ABSTRACT

A pop action toy assembly having an elastomeric body that is defined primarily by a first surface and a second surface. The elastomeric body is selectively positionable between a normal orientation, where the first surface faces outwardly, and an inverted orientation, where the second surface faces outwardly. In use, the elastomeric body is manually inverted. As the inverted body strikes the ground, the toy assembly pops from an inverted orientation back into its normal orientation. A knob is molded at part of the elastomeric body. The knob can be used to hold the toy assembly when inverted. If the toy assembly is inverted and strikes the ground, the knob act to increase the rebounding force by adding significant mass to the moving apex of the toy assembly.

17 Claims, 7 Drawing Sheets

(56) References Cited

U.S. PATENT DOCUMENTS

| | | | |
|---|---|---|---|
| 2012/0058706 | A1 | 3/2012 | Hudson et al. |
| 2014/0349546 | A1 | 11/2014 | Walterscheid |

* cited by examiner

UNISTRUCTURAL POP-UP HALF BALL TOY

RELATED APPLICATIONS

This application claims the benefit of Australian Innovation Patent No. 2017100391, filed Apr. 6, 2017.

BACKGROUND OF THE INVENTION

1. Field of the Invention

In general, the present invention relates to toys that are spring loaded and pop up into the air when activated. More particularly, the present invention relates to toys that contain a hemispherical structure that is inverted in order to store the spring energy needed to pop the toy into the air.

2. Prior Art Description

Rubber balls have been commercially manufactured for well over a century. The original rubber balls were made from two hemispherical pieces of rubber that were glued together to form the shape of the ball. As the balls were played with, it was not uncommon for the two halves of the ball to separate. A child playing with the ball would then have two half balls. Half-balls were so common that many childhood games required the use of a "half ball".

One game played with a half ball is to invert the half ball so that it will eventually pop back into its original shape. When a half ball is inverted it stores energy like a spring. If the inverted ball were dropped or touched, the half ball would pop back into its hemispherical shape, thereby releasing the stored energy. The popping action of the half ball would cause the half ball to fly up into the air.

Recognizing the play value of half balls, toy manufacturers began to manufacture half balls and configure the half balls to optimize the popping action. Such half balls are exemplified by U.S. Pat. No. 2,153,957 to Davis, entitled Jumping Ball, which was patented in 1939. In more recent patents, secondary objects, such as dolls and superheroes have been attached to half balls. In this manner, when the half ball pops and flies into the air, so does the toy character. Half balls that carry secondary characters are exemplified by U.S. Pat. No. 5,213,538 to Willett, entitled Pop-Action Bouncing Doll.

Half ball popping toys have certain problems that are inherent with their design. If a half ball is made from a material that is too thick or has too high a durometer, then the half ball will not remain inverted for long. As soon as the half ball is inverted, the half ball begins to bend back toward its original hemispherical shape. The half ball will therefore pop back into its hemispherical shape only a few moments after it is inverted. If a half ball is made too thin or with a material that has too low a durometer, then the half ball will not store much energy when it is inverted. The half ball will, therefore, not pop back into its original hemispherical shape with much energy and the toy will not pop into the air.

To avoid these problems, toy manufacturers usually balance material thickness and durometer to create a half ball that remains in an inverted shape indefinitely yet stores enough energy to actively pop once triggered. In order to trigger the inverted half ball, the half ball must be dropped or momentarily pressed. Pressing an inverted half ball is problematic, seeing that the hand used to press the inverted half ball usually gets in the way of the half ball when it suddenly pops. Dropping a half ball is equally problematic, seeing that the half ball will only activate if it strikes the ground flush on its base or upon its apex. If the half ball strikes the ground at an angle, the energy of the impact may not act to change the configuration of the half ball and the half ball may remain inverted.

In U.S. Pat. No. 7,803,033 to Walterscheid is owned by KMA Concepts Limited, the applicant herein. The Walterscheid patent shows a hemispherical body and a central knob that is assembled into the body. This requires that a hole be formed in the hemispherical body at the apex of its curvature, in order to accommodate the insertion of the knob. As the toy ages, the elastomeric material used to mold the hemispherical body may become less pliant. This can cause cracks to form in the material around the hole of the knob. Should the material crack, the knob may separate from the hemispherical body, therein causing the toy to break.

A need therefore exists for an improved hemispherical pop-up toy with an integrated knob that cannot be separated from the toy. In this manner, the toy can be inverted and caused to pop back into its original hemispherical shape with far more consistency and predictability than is available in the prior art. This need is met by the present invention as described and claimed below.

SUMMARY OF THE INVENTION

The present invention is a pop action toy assembly. The pop action toy assembly has an elastomeric body that is defined primarily by a first surface and a second surface. Both the first surface and the second surface converge from a wide base rim to a central apex. The elastomeric body is selectively positionable between a normal orientation, where the first surface faces outwardly, and an inverted orientation, where the second surface faces outwardly.

A knob extends from the second surface of the elastomeric body at the central apex. The knob is used to grasp, spin and throw the toy assembly. The knob is molded as part of the elastomeric body, therein adding thickness and mass to the central apex.

A plurality of nubs can be provided that symmetrically protrude from the first surface of the elastomeric body. When the toy assembly is inverted, the nubs are the lowest part of the toy assembly. That is, the inverted toy assembly would rest upon the nubs if placed on a surface. The nubs are positioned to concentrate the force of the impact when the inverted toy assembly is dropped or otherwise impacted. The nubs, therefore, assist the toy assembly in popping back into its normal orientation after being inverted.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

The present invention is an improved pop-up half ball toy. The present invention can be configured in many ways, such as in a pop-up doll or some other pop-up toy character. However, for the purposes of illustration and discussion, only one unadorned embodiment of the invention is shown. The exemplary embodiment sets forth one of the best modes contemplated for the invention. The illustrated embodiment, however, is intended to be exemplary and should not be considered as limiting the scope of the appended claims.

Figure 1:
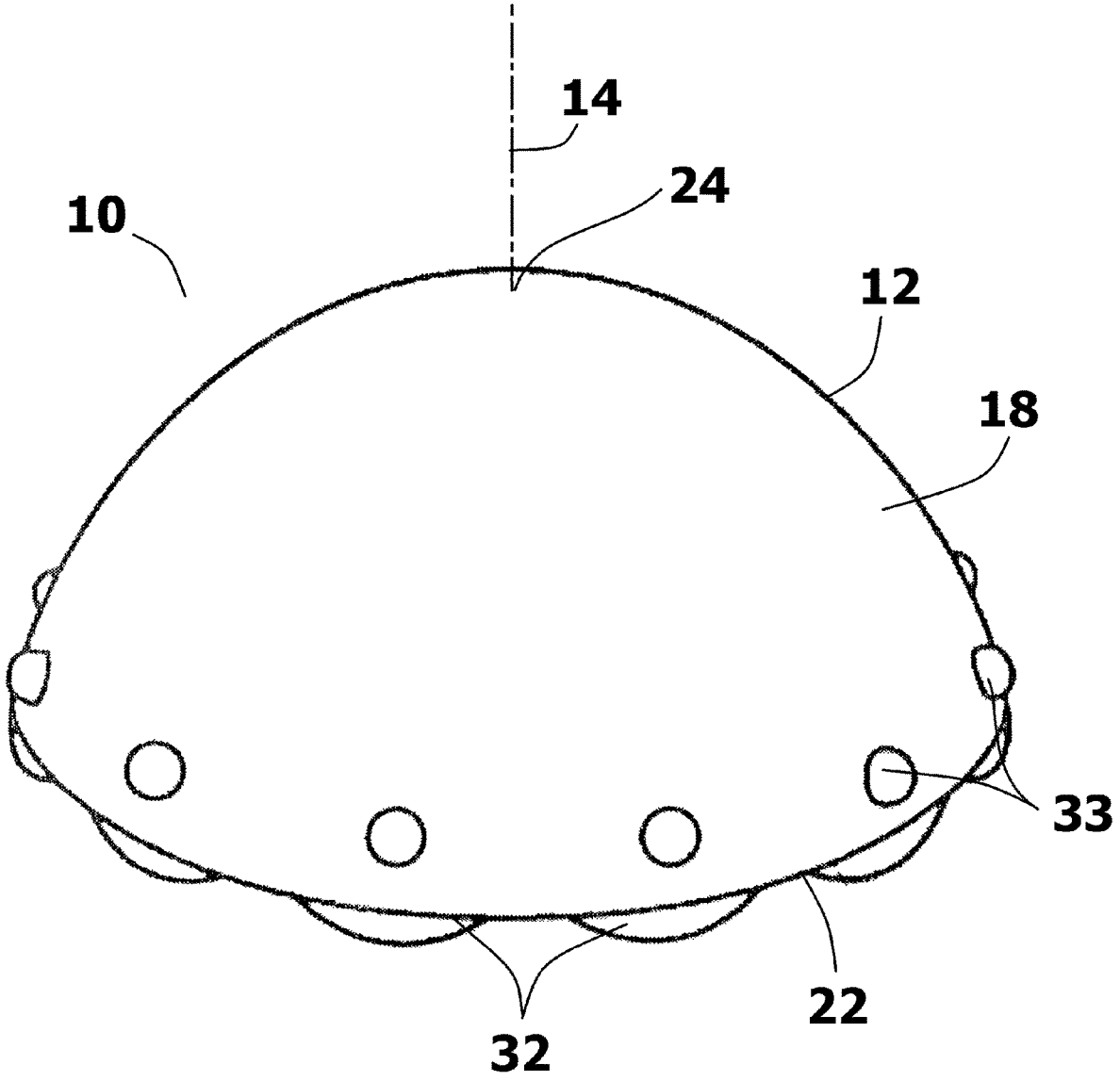
FIG. 1 is a perspective view of an exemplary embodiment of a pop action toy assembly in its normal configuration.
Figure 2:
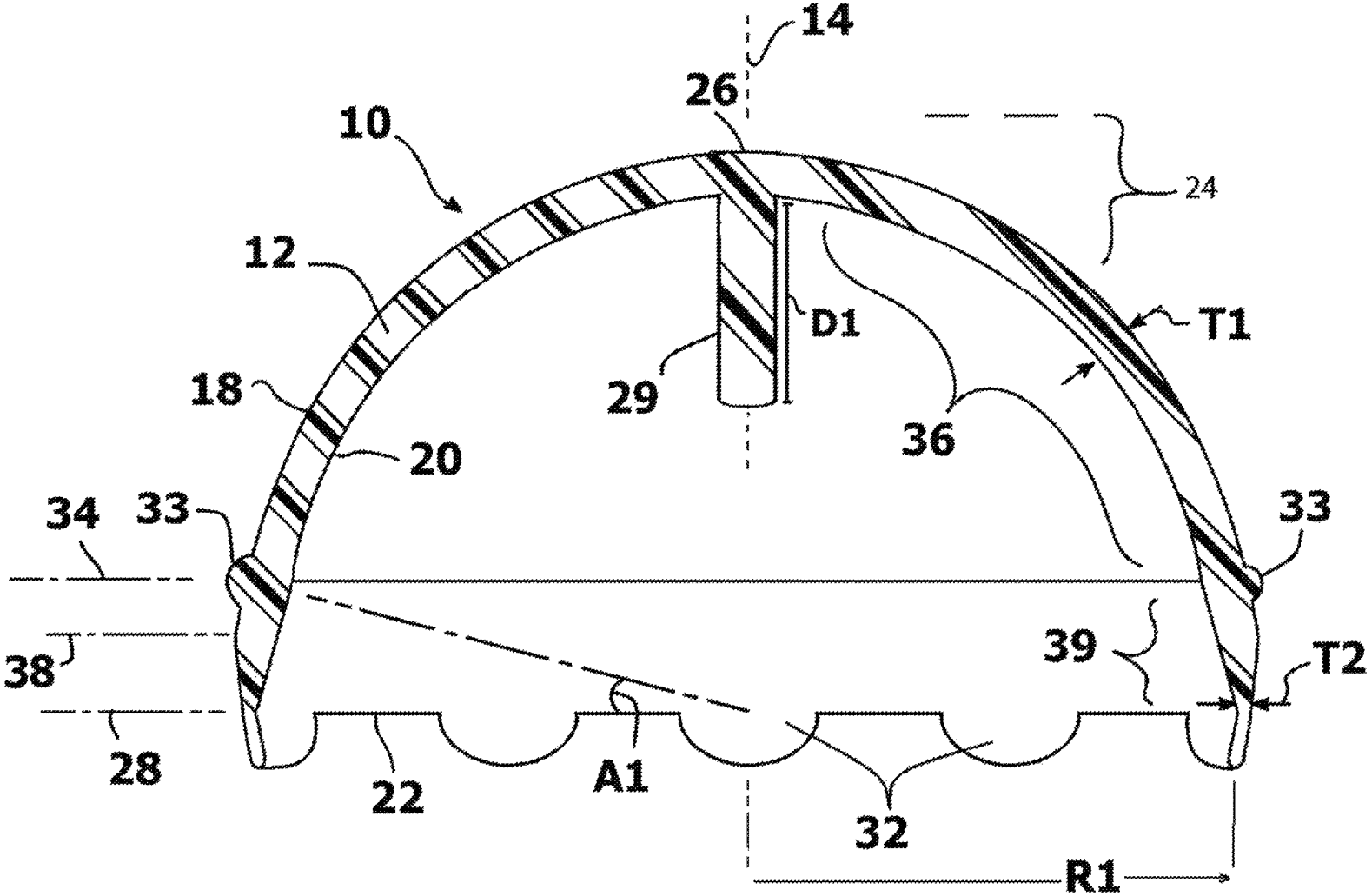
FIG. 2 is a cross-sectional view of the embodiment of FIG. 1.

Referring to FIG. 1 in conjunction with FIG. 2, a pop-up action toy 10 is shown in its normal configuration. The pop-up action toy 10 has a half ball body 12 that is symmetrically disposed around an imaginary vertical mid-axis 14. The half ball body 12 is made of a highly elastomeric material, such as rubber or a synthetic rubber. The half ball body 12 is defined primarily by a first surface 18 and a second surface 20. The first surface 18 and second surface 20 both converge from a wide base rim 22 toward a central apex 24. The half ball body 12 is solid, having no holes, slots or other openings at any point between the base rim 22 and the central apex 24. When the half ball body 12 is in its normal configuration, as is shown in FIG. 1 and FIG. 2, the first surface 18 is the exterior surface of the half ball body 12.

The base rim 22 of the half ball body 12 exists in a rim plane 28 that is perpendicular to the mid-axis 14. The base rim 22 has a radius R1, as measured from the mix-axis 14. The first surface 18 of the half ball body 12 is hemispherical in shape, having a consistent radius from the central apex 24 down to the rim plane 28. Accordingly, the first surface 18 of the half ball body 12 is primarily smooth and rounded. A plurality of protruding tabs 32 extend down from the half ball body 12 below the rim plane 28. The protruding tabs 32 are symmetrically dispersed around the mid-axis 14 along the base rim 22.

A knob 29 extends from the second surface 20 of the half ball body 12 at the central apex 24. The knob 29 is integrally molded as part of the half ball body 12 from the same material as is the half ball body. The knob 29 extends a distance D1 below the central apex 24, wherein the distance D1 is between thirty percent and fifty percent of the radius R1 of the base rim 22. The purpose of the knob 29 is later explained.

A plurality of nubs 33 can be disposed on the first surface 18 of the half ball body 12. Each of the nubs 33 is a protrusion that extends away from the otherwise smooth first surface 18. All the nubs 33 are disposed in a common plane 34 that is parallel to the base plane 22. When the half ball body 12 is in its normal configuration, as illustrated, the common plane 34 of the nubs 33 is disposed between the base plane 28 and the central apex 24. All of the nubs 33 are symmetrically disposed, around the vertical mid-axis 14 on the first surface 18. In the illustrated embodiment, there is one nub 33 disposed above each of the protruding tabs 32. As such, the number of nubs 33 corresponds to the number of protruding tabs 32. However, this ratio is exemplary, and the number of nubs 33 cam differ from the number of protruding tabs 32. As measured from the geometric center of the base plane 28, the common plane 34 of the nubs 33 is positioned at an angle of inclination A1 above the base plane 22. The angle of inclination A1 is between 5 degrees and 25 degrees above the base plane 28, depending upon the diameter of the base rim 22. As will later be described, the presence of the nubs 33 is used to help the pop action toy 10 pop from an inverted configuration into the shown normal configuration.

The second surface 20 of the half ball body 12 is complex. When the half ball body 12 is in its normal configuration, as is shown in FIG. 1 and FIG. 2, the second surface 20 is the interior surface of the half ball body 12. A uniform section 36 of the second surface 20 extends from an aperture 26 at the central apex 24 to a transition plane 38. The transition plane 38 lay approximately two-thirds of the way down the half ball body 12. In the exemplary embodiment, the transition plane 38 is coplanar with the common plane 34 of the nubs 33. However, it should be understood that the transition plane 38 can be higher and closer to the central apex 24, than is the common horizontal plane 34 of the nubs 33.

The half ball body 12 has a uniform section 36. In the uniform section 36, the half ball body 12 has a uniform thickness T1. Below the transition plane 38, the half ball body 12 enters a tapered section 39 and begins to thin. The thickness of the half ball body 12 thins between 30% and 60%, from a first thickness at the transition plane 38 to a thinner second thickness T2 at the rim plane 28. The protruding tabs 32 maintain the second thickness T2 along their lengths.

It has previously been mentioned that the knob 29 is molded as part of the half ball body 12. As such, the knob 29 cannot be separated from the half ball body 12. The presence of the knob 29 adds significant mass to the central apex 24 of the half ball body 12. This makes the central apex 24 much more difficult to pierce or wear away than other areas along the half ball body 12. The increased mass at the central apex 24 also significantly increases the rebounding force created when the half ball body 12 pops out of an inverted configuration and the central apex 24 strikes a surface. The rebounding force is a product of the mass times its acceleration. As a consequence, the increase in mass due to the knob 29 creates a proportional increase in the rebounding force as the half ball body accelerates between it inverted configuration and normal configuration.

Figure 3:
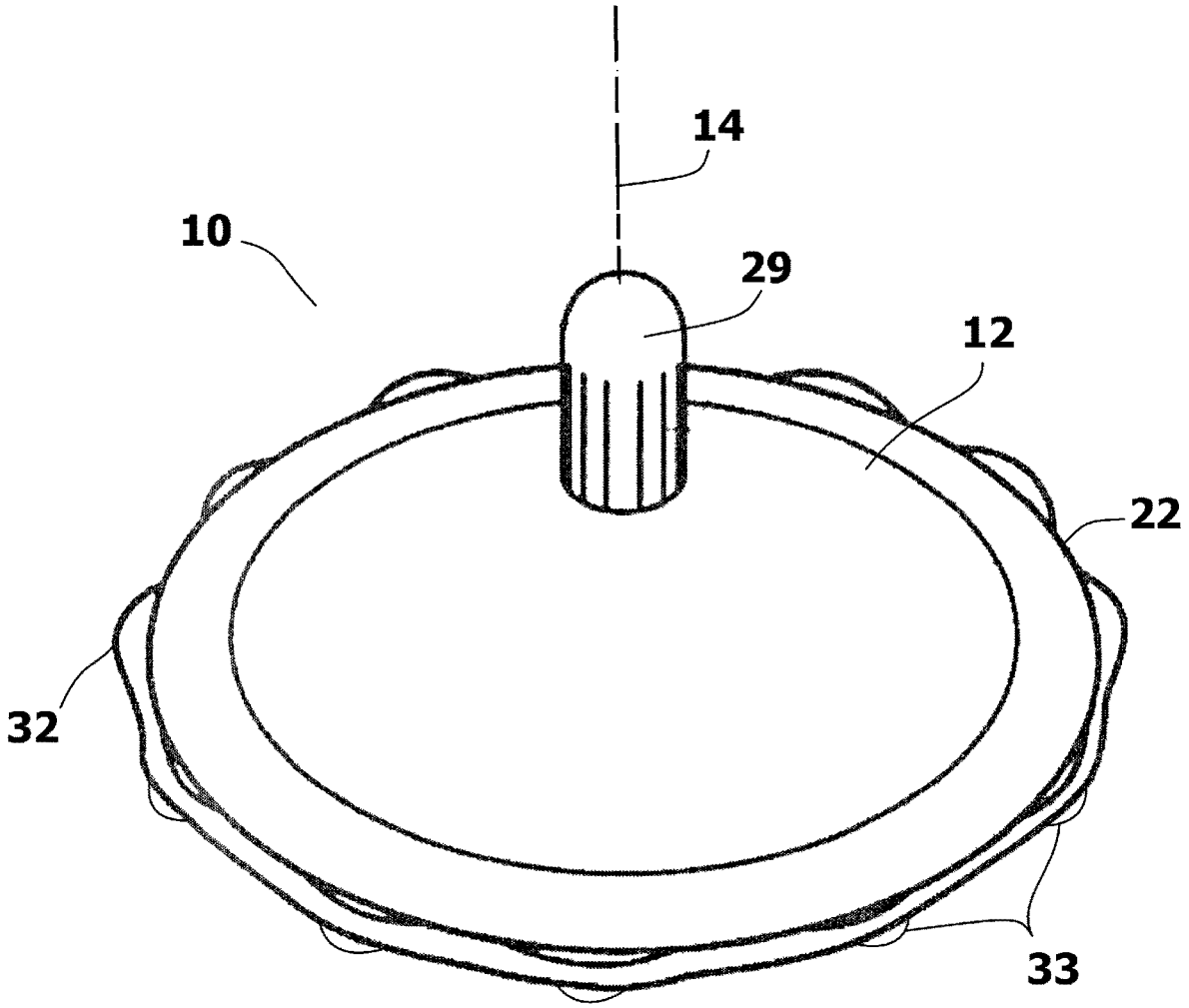
FIG. 3 is a perspective view of an exemplary embodiment of a pop action toy assembly in its inverted configuration.
Figure 4:
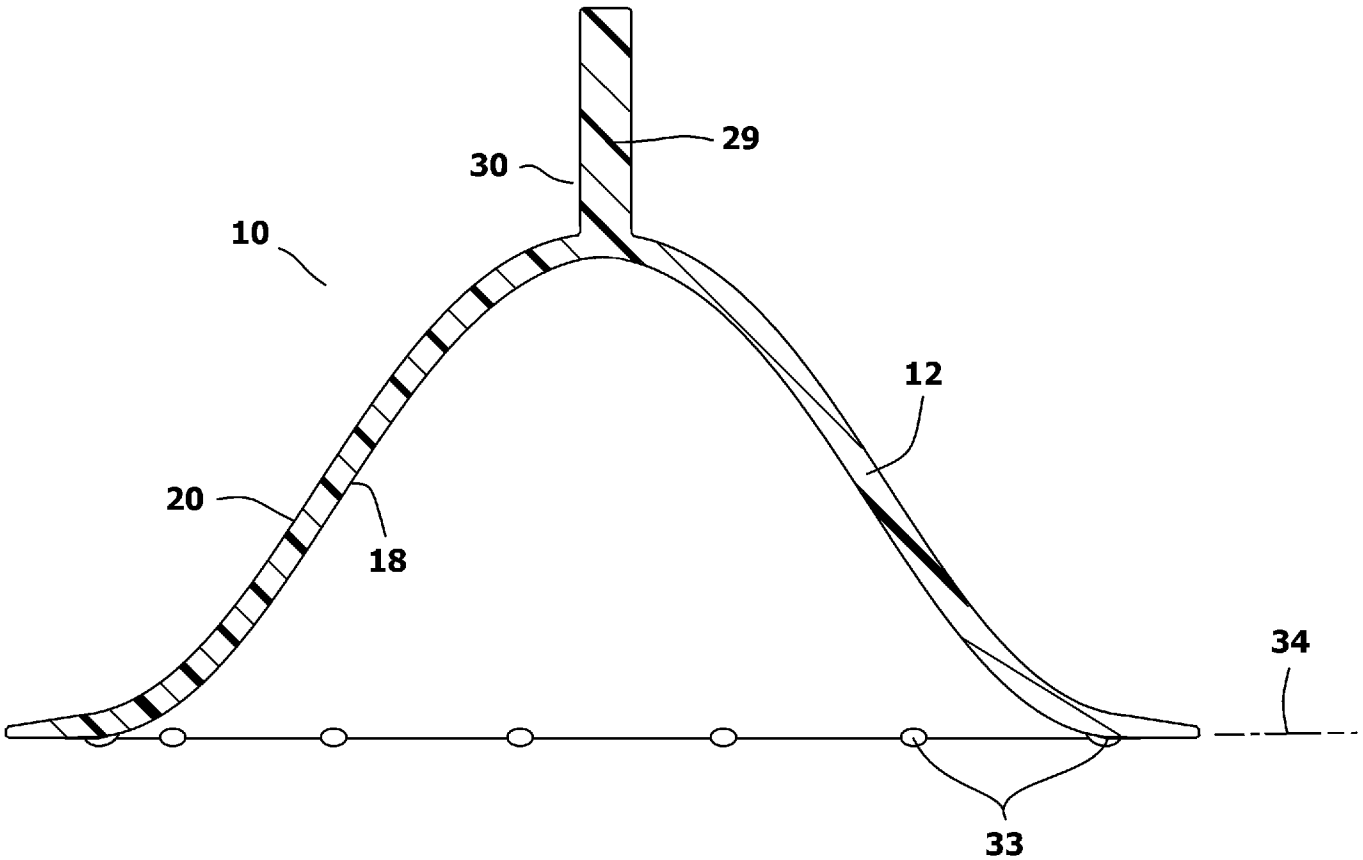
FIG. 4 is a cross-sectional view of the embodiment of FIG. 3.
Figure 5:
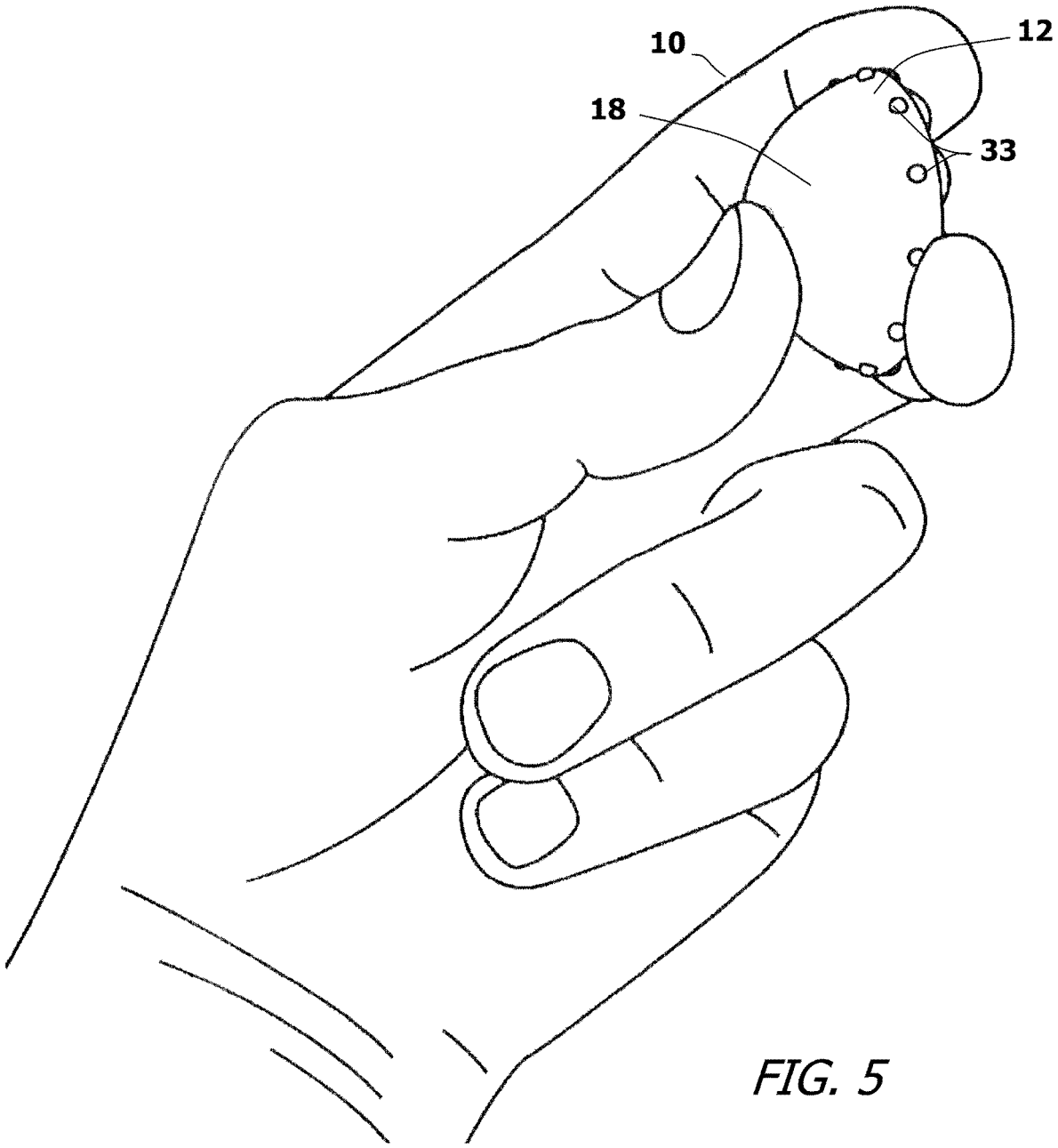
FIG. 5 shows the pop action toy assembly held in a hand in its normal configuration.
Figure 6:
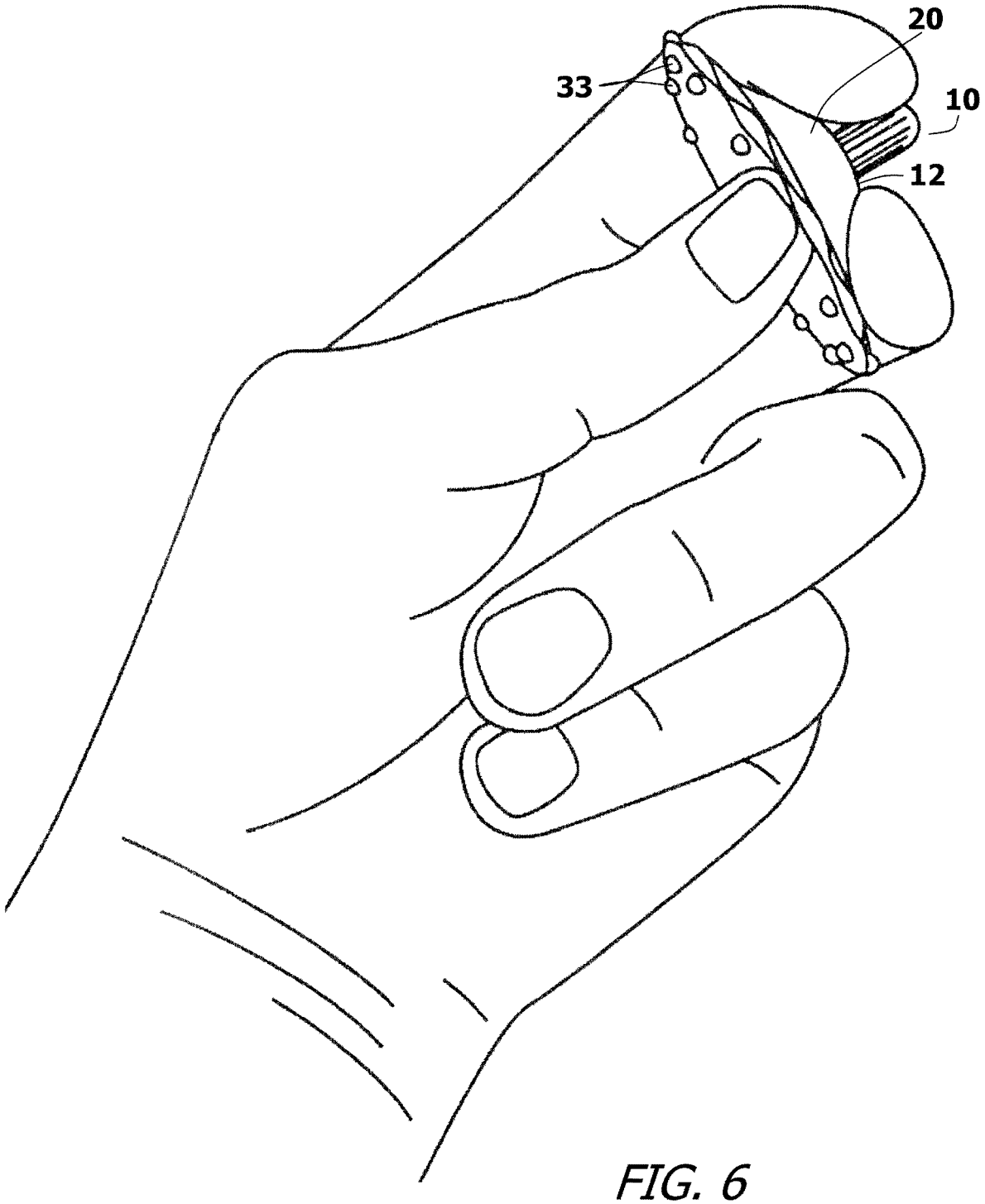
FIG. 6 shows the pop action toy assembly held in a hand in its inverted configuration.

Referring to FIG. 3 and FIG. 4 in conjunction with FIG. 5 and FIG. 6, it can be seen that the half ball body 12 of the pop action toy 10 can be inverted by depressing the central apex region 24 of the half ball body 12. When the half ball body 12 is inverted, the half ball body 12 bends and the uniform section 36 of the second surface 20 follows a first toric curvature. Additionally, the tapered section 39, being less thick, deforms more readily and curves to a greater degree. This alters the positions of the nubs 33. The nubs 33 become the parts of the half ball body 12 that are the farthest from the inverted apex. That is, the common plane 34 of the nubs 33 is the farthest part of the half ball body 12 from the inverted central apex 24 of the half ball body 12. As such, the nubs 33 are the lowest points on the inverted half ball body 12. It will therefore be understood, that if the pop action toy 10 is placed upon a flat surface, while inverted, the nubs 33 would be in contact with that flat surface.

When the half ball body 12 is inverted, the knob 29 extends upwardly at the top of the pop action toy 10. The knob 29 can be readily grasped by the hand of a person. Utilizing the knob 29, a person can rotate the entire pop action toy 10 like a top. If the inverted pop action toy 10 is thrown as it is spun, the spinning action stabilizes the pop action toy 10 in flight. When the inverted pop action toy 10 lands, its stable flight orientation commonly causes the nubs 33 at the lowest part of the pop action toy 10 to contact the ground first.

Any upward contact to the nubs 33 on the inverted half ball body 12 acts to cause the half ball body 12 to pop back into its original shape. Accordingly, if the pop action toy 10 is inverted and is dropped to the ground at any height greater than a few inches, the force of the impact with the ground will cause the inverted half ball body 12 to instantly pop back into its original hemispherical shape. The pop action is particularly sensitive to contact with the nubs 33. Since the nubs 33 are periodically spaced at the bottom of the inverted half ball body 12, it will be understood that one of the nubs 33 is likely to strike the ground first. Any impact to one of the nubs 33 concentrates the forces of the impact into the small area of the nub 33. Consequently, only a small impact force will cause the inverted half ball body 12 to pop back into its original hemispherical shape.

Figure 7:
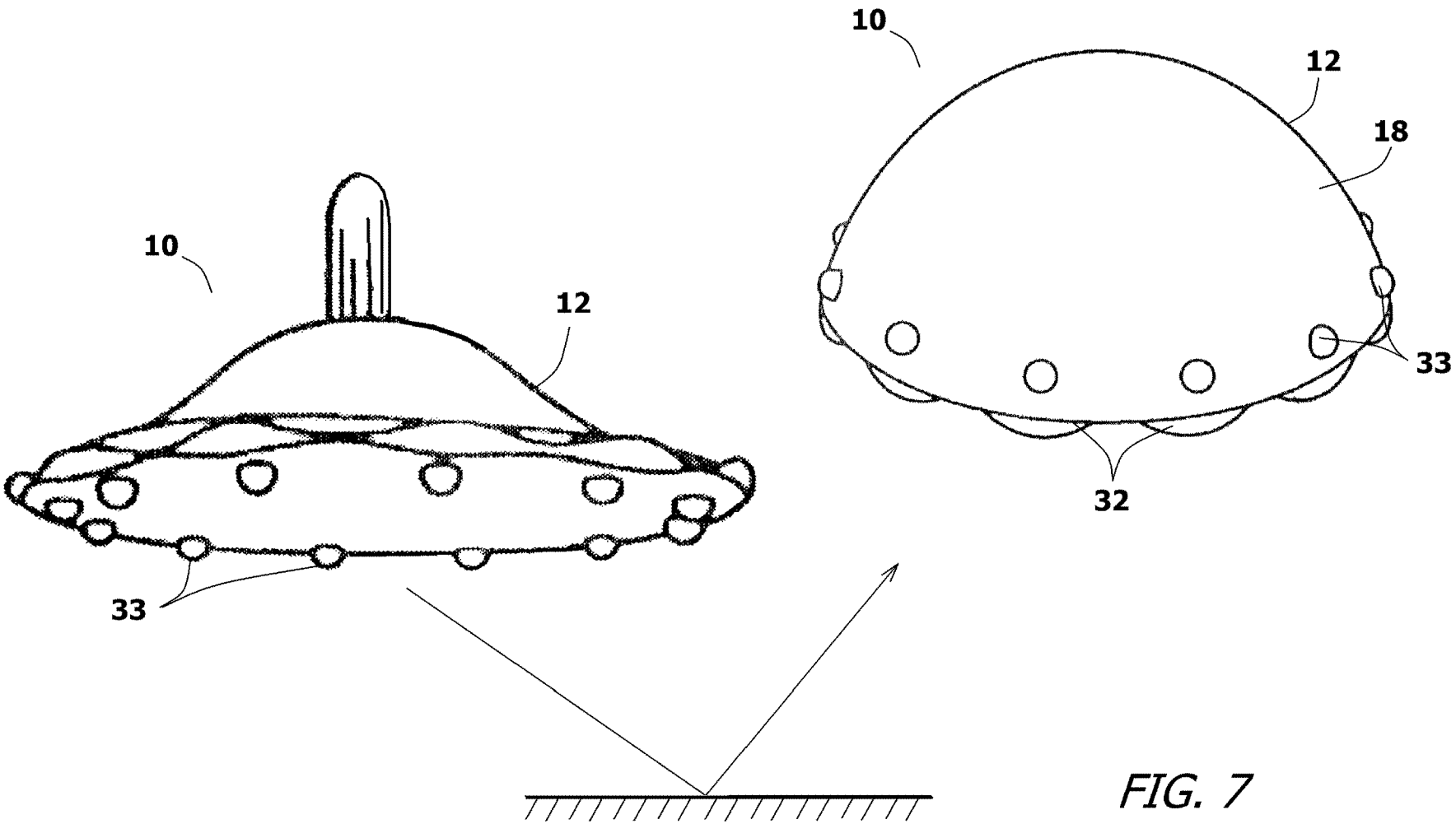
FIG. 7 illustrates the rebounding action of the pop action toy assembly as it pops from an inverted configuration back into a normal configuration.

Referring to FIG. 7, in conjunction with FIG. 2 and FIG. 4, it will be understood that in order to utilize the pop action toy 10, the half ball body 12 is manually manipulated into its inverted configuration. A user then can grasp the knob 29. Using the knob 29, a person spins and throws the inverted pop action toy 10. The inverted pop action toy 10 flies through the air and eventually strikes the ground. At the moment of impact, a nub 33 or another part of the wide base rim 22 strikes the ground. The force of the impact causes the inverted half ball body 12 to immediately convert back to its original hemispherical shape. At the moment of conversion, the energy stored in the inverted half ball body 12 is released. The stored energy causes the central apex 24 and the knob 29 to be driven downwardly down toward the ground. The rebounding force is a function of the mass of the knob 29 plus the mass of the inverting body times the acceleration. The rebounding force supplies an upward force to the pop action toy 10. The pop action toy 10 will therefore rebound off the ground with great energy. Preferably, the energy utilized for the rebound causes the pop action toy 10 to fly up into the air to a height of between three and ten feet. The pop action toy 10 will therefore "bounce" up off the ground when dropped, often to a height greater than from where it was dropped.

It will be understood that the embodiment of the present invention that is illustrated and described is merely exemplary and that a person skilled in the art can make many variations to that exemplary embodiment. For instance, the number, shape and size of the nubs can be varied. The shape and size of the half ball body and knurled knob can also be varied. All such variations, modifications and alternate embodiments are intended to be included within the scope of the present invention as defined by the claims.

What is claimed is:

1. A pop action toy assembly, comprising:

an elastomeric body having a first surface and a second surface, said elastomeric body being symmetrically disposed around a mid-axis, wherein said first surface and said second surface both extend from a base rim to a central apex, wherein said elastomeric body is selectively positionable between a normal orientation, where said first surface faces outwardly, and an inverted orientation, where said second surface faces outwardly, and wherein said elastomeric body is deformed and stores energy when in said inverted orientation;

a plurality of nubs that are disposed in a common plane on said first surface of said elastomeric body, wherein said common plane is perpendicular to said mid-axis, said common plane of said plurality of nubs being interposed between said base rim and said central apex when said elastomeric body is in said normal orientation, and said common plane of said plurality of nubs being farthest from said central apex along said mid-axis when said elastomeric body is converted into said inverted orientation, and a knob extending from said second surface of said elastic body at said central apex, wherein said knob is symmetrically formed along said mix-axis and wherein said knob is integrally molded as part of said elastomeric body.

2. The assembly according to claim 1, wherein said base rim has a radius and said knob extends from said central apex along said mid-axis for a first distance that is between thirty percent and fifty percent of said radius.

3. The assembly according to claim 1, wherein said base rim exists in a base plane that is parallel to said common plane of said plurality of nubs.

4. The assembly according to claim 3, wherein a transitional plane exits between said base rim and said central apex that is parallel to said base plane, wherein said elastomeric body tapers in thickness between said first surface and said second surface, from a first thickness at said base rim to a second larger thickness at said transition plane.

5. The assembly according to claim 4, wherein said common plane of said plurality of nubs is disposed between said transition plane and said central apex.

6. The assembly according to claim 4, wherein said common plane of said plurality of nubs is coplanar with said transition plane.

7. The assembly according to claim 1, wherein said first surface is hemispherical in shape when said elastomeric body is in said normal orientation.

8. The assembly according to claim 1, further including a plurality of tabs symmetrically extending from said base rim of said elastomeric body.

9. A pop action toy assembly, comprising:

an elastomeric body having a first surface and a second surface that are symmetrically disposed around a mid-axis, wherein said first surface and said second surface both converge from a base rim to a central apex, wherein said elastomeric body is selectively positionable between a normal orientation, where said first surface faces outwardly, and an inverted orientation, where said second surface faces outwardly, wherein said elastomeric body is deformed and stores energy when in said inverted orientation;

a plurality of nubs disposed on said first surface of said elastomeric body in between said base rim and said central apex, wherein said plurality of nubs are farthest from said central apex along said mid-axis when said elastomeric body is converted into said inverted orientation, and a spin knob extending beyond said second surface at said central apex, wherein said spin knob is the highest part of said pop action toy when said elastomeric body is in said inverted orientation.

10. The assembly according to claim 9, wherein said base rim has a radius and said knob extends from said central apex for a first distance that is between thirty percent and fifty percent of said radius.

11. The assembly according to claim 10, wherein said plurality of nubs are all disposed in a common plane on said first surface of said elastomeric body.

12. The assembly according to claim 11, wherein said elastomeric body tapers in thickness between said first surface and said second surface, from a first thickness at said base rim to a second larger thickness at a transition plane between said base rim and said central apex.

13. The assembly according to claim 12, wherein said elastomeric body has a uniform thickness between said first surface and said second surface from said transition plane toward said central apex.

14. The assembly according to claim 13, wherein said common plane of said plurality of nubs is disposed between said transition plane and said central apex.

15. The assembly according to claim 14, wherein said common plane of said plurality of nubs is coplanar with said transition plane.

16. The assembly according to claim 9, further including tabs that extend from said base rim of said elastomeric body.

17. The assembly according to claim 9, wherein said first surface is hemispherical in shape when said elastomeric body is in said normal orientation.

* * * * *